US005083770A

United States Patent [19]

Holland

[11] Patent Number: 5,083,770

[45] Date of Patent: Jan. 28, 1992

[54] THEATRICAL ACCESSORY

[76] Inventor: Maeford J. Holland, 9323H Loveland-Madeira Rd., Cincinnati, Ohio 45242

[21] Appl. No.: 687,457

[22] Filed: Apr. 17, 1991

[51] Int. Cl.[5] ..... A63J 3/00

[52] U.S. Cl. ..... 272/8 R; 446/27

[58] Field of Search ..... 272/8 N, 8 R, 27 N, 272/27 R, 25; 446/26, 27, 395

[56] References Cited

U.S. PATENT DOCUMENTS

| | | | |
|---|---|---|---|
| 714,534 | 11/1902 | Thomas | 272/25 |
| 2,606,324 | 8/1952 | Mafko | 446/27 X |
| 4,676,500 | 6/1987 | Fricano | 446/27 X |

*Primary Examiner*—Mickey Yu
*Attorney, Agent, or Firm*—Roy F. Schaeperklaus

[57] ABSTRACT

A blood dripping fang theatrical accessory is disclosed. Controlled dripping of simulated blood from discharge ports of a bladder of the accessory may be effected by the user. The accessory has a hollow backed thin, flexible rubber-like shell simulating the appearance of an assemblage of fangs, teeth and gum. A bladder having a main body and a pair of tubular body branches is mounted on the back of the shell with its tubular body branches nested in the hollow backs of the fangs, the tubular body branches having apertures adjacent the tips of the fangs remote from the main body. Resilient material couples the bladder branches to the fangs. The accessory may be held in the mouth of the user with the fang portions projecting therefrom. The bladder portion is engageable by part of the tongue of the user which may compress the bladder to discharge simulated blood from the apertures adjacent the fang tips and interrupt or terminate such discharge by stopping further compression or by decompression of the bladder.

12 Claims, 1 Drawing Sheet

THEATRICAL ACCESSORY

This invention relates to theatrical accessories, and in particular to a fang accessory adapted to drip simulated blood as desired from the fangs under the control of the user of the accessory.

BACKGROUND OF THE INVENTION

An object of this invention is to provide an accessory comprising a thin flexible rubber-like hollow shell body molding having a three-dimensional front surface simulating the appearance of a pair of fangs and adjacent teeth in association with a simulation of a portion of gum, and the back whereof is concave and adapted to receive, conceal and hide a resilient bladder having a pair of tubular branches mounted in nested and concealed relation in respective portions of the hollow shell simulating fangs with a discharge opening adjacent the fang tips.

A further object of this invention is to provide a theatrical appliance for simulating blood dripping fangs in which the dripping of blood from the fangs may be controlled by the user of the accessory.

Another object of this invention is to provide an accessory of the foregoing character in which the bladder serves as a reservoir for holding simulated blood and is composed of material which is preferably not wettable by the simulated blood placed therein with the result that the surface tension of the simulated blood tends to cause the simulated blood to remain in the reservoir until discharged therefrom by sufficient mechanical compression of the reservoir against the gums or roof of the user's mouth by the tongue of the user. The discharge is arrested by decrease in the tongue pressure on the reservoir, which then expands toward its uncompressed state.

A further object of this invention is to provide a device of the foregoing character in which simulated blood may be charged from a collapsible container into the reservoir through the discharge opening in the end of the tubular bladder branch concealed in one of the fangs which is positioned lowermost, to progressively fill the bladder branch in the one fang, the reservoir and the second bladder branch until the simulated blood reaches the discharge opening at the end of the second tubular portion of the reservoir, while the latter opening is the uppermost portion of the reservoir.

The above and other features and objects of the invention will in part be apparent and in part be obvious from the following description of the preferred embodiment of the invention and the drawings.

DESCRIPTION OF PRESENTLY PREFERRED EMBODIMENT

Figure 1:
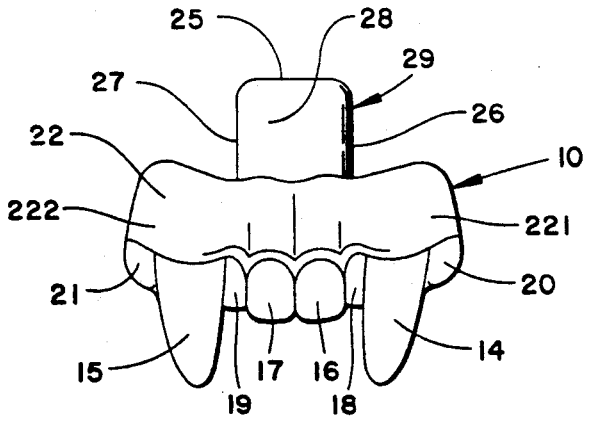
FIG. 1 is a view in front elevation of the preferred embodiment of this invention.

The illustrative preferred embodiment as shown in FIG. 1 may have a thin flexible rubber-like molded hollow shell body 10 and a bladder 11.

The shell body 10 has fang portions 14,15 which protrude forwardly of more conventional teeth 16, 17, 18, 19, 20 and 21. Teeth 16 and 17 are centrally located and fully visible, while teeth 18, 19, 20 and 21 are partly visible and have the appearance of extending behind and being partly covered by respective fangs 14,15. Gum simulating portion 22 extends upwardly of the teeth which appear to protrude from the lower portions thereof. Gum simulating portion 22 has a convex front face which extends upwardly from the teeth to the upper edge of rearwardly facing shell body face 12.

Figure 2:
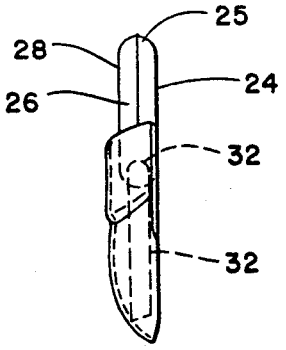
FIG. 2 is a view in side elevation of the device shown in FIG. 1.
Figure 3:
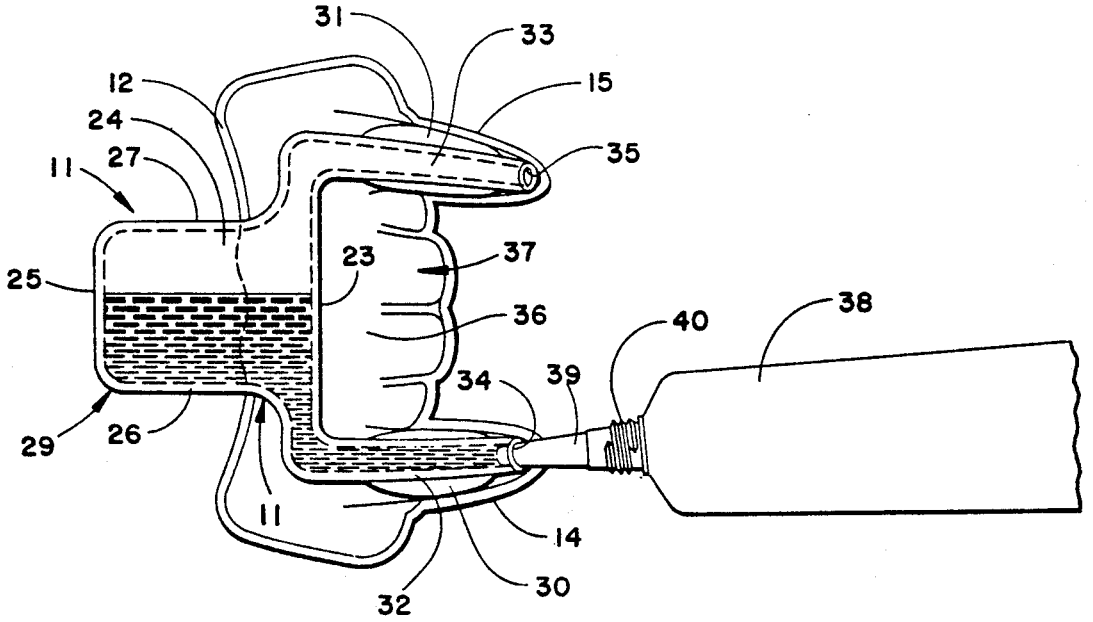
FIG. 3 is a rear view of the device of FIG. 1 in a position desirable for initial charging of simulated blood into the reservoir from a collapsible tube.

Bladder 11 has a main body portion 29 of generally rectangular outline when viewed from front or rear. Main body portion 29 has a front wall 28 and a rear wall 24 which are joined by top 25, bottom 23 and sides 26,27. The top, bottom and sides of the main body of the bladder are shown rounded to a semi-cylindrical form in a fashion represented by top 28 viewed from an end in FIG. 2. From the lower portion of the main body of bladder 11, tubular bladder branches 32,33 extend laterally and downwardly as shown in FIGS. 2 and 3. The ends of the branches 32,33 remote from the main body of the bladder have apertures 34,35 through which the interior of the bladder may be in communication with the atmosphere.

The bladder 11 as shown particularly in FIG. 3 is mounted adjacent the rear face of the hollow shell body 10 with the tubular bladder branches nested in and substantially concealed by fang portions 14,15 and the forward face 28 of the bladder resting against the central portion of body shell edge 12. The bladder and body shell are secured together by respective adhesive bodies 30,31 which are preferably of flexible character so that the tubular bladder branches, the adhesive bodies and the fangs and adjacent portions of the body shell are secured in substantially fixed relation to each other in a manner such that the joined portions comprise a flexible structure which is somewhat stiffer in the area of joinder.

Main body portion 29 of bladder 11 is of generally rectangular outline when viewed from front or rear, with its sides, top and bottom curved to provide a rounded contour as is best illustrated in FIG. 2 at 25. The rounded contour contributes to the comfort of the user. When the appliance is inserted in the mouth of a user the bottom of the reservoir 23 is substantially horizontal and extends side-to-side, as does the top 25, while the sides 26,27 of the bladder are substantially vertical when viewed from the front or rear. However, the bladder, as well as the shell in which it is mounted, when in the position of use in the mouth of a user, is canted upwardly and into the mouth so that the fangs and teeth project downwardly out of the mouth of the user into positions where they can be seen by viewers. The downwardly and outwardly canting of the teeth, particularly the fangs, is determined by the fact that the upper forward face of the shell body 10 and the forward face of the bladder 11 projecting upwardly therefrom are positioned in the user's mouth and lie substantially face-to-face against the back side of the upper teeth and fleshy gum and other mouth surfaces above the teeth of the user. As shown in FIGS. 2 and 3, the bladder 11 nests against the concave rear surface of the shell body 10 where it is mounted by bodies of adhesive material 30,31 which join tubular bladder branches 32,33 in the position shown in FIGS. 2 and 3 in the concave rear portions of the fangs. The adhesive bodies 30,31 and tubular bladder portions 32,33 are in mutually supporting relation to the fangs 14,15 so as to stiffen the fang portions of the accessory to project from the user's mouth.

The left and right side portions 221,222 of gum 22 project laterally of fangs 14,15 and cooperate with the user's mouth surfaces adjacent the mouth opening which support the accessory in position in the user's mouth. Additionally, the user's tongue tip can engage in the pocket 37 bounded by the bottom of the bladder 23, tubular bladder portions 32,33 and the concavely contoured rear surface area 36 of shell body 10. The tip portion of the user's tongue can be held in engagement in the pocket 37 to hold the accessory in place, while other portions of the user's tongue in engagement with the rear wall of the bladder can compress the bladder to discharge and permit it to expand as desired to interrupt discharge of simulated blood from the fangs 14,15 as and when desired. The working of part of the tongue incident to compressing and decompressing the bladder while the fore part of the tongue is in engagement with the pocket of the accessory can produce movement of the fangs, viz. to cant the fang tips to project further from or retract toward the adjacent external body surfaces of the user for increased theatrical effect.

The bladder 11 is preferably formed of flexible transparent or translucent materials of any of a number of materials such as rubber based or synthetic resin based moldable products. The material used is preferably one which is not wetted by the simulated blood which may be used therein by the user. Additionally, the simulated blood has physical properties, viz., viscosity such that the material does not flow out of the discharge ports of the bladder except when the latter is subjected to compression which forces the simulated blood from the ports 34,35 of bladder branches 32,33.

There are simulated blood products available on the market. One such product I prefer is known as "Dagger Blood", which has a pH of 10.3 to 11, a viscosity of 4500 to 5500 cps, and, because it loses its color as it dries, is known as "disappearing blood". The "disappearing blood" is marketed in a collapsible tube 38 having a tapered spout 39 closable by a cap (not shown), threads of which may be engaged onto threads 40 at the base of the spout to seal the container. The spout 39 tapers and is of a size such that the tip portion of the spout may be inserted into aperture 34 at the discharge end of bladder branch 32 as shown in FIG. 3. The spout 39 is inserted through aperture 34 into branch 32 until it is wedged sealingly in aperture 34. The theatrical accessory may be positioned as shown in FIG. 3 with bladder tubular branch 32 substantially horizontal and branch 33 of the bladder at an elevated position. The body of the collapsible tube 38 is compressed expelling simulated blood through spout 39 into tubular bladder branch 32. The material flows through branch 32 and into main body portion 29. As the level of simulated blood in main bladder portion 29 rises, the appliance may be rotated counterclockwise from the position in which it is shown in FIG. 3 so that the simulated blood with force air from the bladder as the blood progressively fills the bladder. As a result, the simulated blood will fill the main body portion 29 of the body and then rise in bladder branch 33 until the bladder and its branches are filled with simulated blood when the latter reaches aperture 35 at the tip of branch 33, whereupon the appliance may be placed with its fore surface facing downwardly and bladder branches 32,33 horizontal and the collapsible supply tube nozzle may be disengaged from bladder branch 32 and capped to prevent further discharge of simulated blood from the supply tube.

It is desirable to fill the bladder completely so that if the temperature of the theatrical appliance and the simulated blood are below body temperature, the installation of the theatrical appliance in the mouth of the user can be accomplished with minimal outflow of blood from the bladder through apertures 34,35 because the rate of thermal expansion of the liquid is slight; whereas, if a substantial quantity of air at a temperature substantially below body temperature were present in the bladder, it would expand and cause discharge of liquid from the tips of the branches at apertures 34,35. As shown, the bladder 11 has substantial areas which are in contact with body surfaces of the mouth and tongue so that the contents of the bladder are fairly quickly heated to near body temperature. As simulated blood is discharged through apertures 34 and 35 as a result of the compression of the central bladder portion by the tongue against the opposed mouth surfaces, the volume of the bladder is temporarily reduced, and when the discharge of blood is terminated, the bladder is permitted to reexpand. When sufficient simulated blood has been discharged, air will be drawn through the branch tips 32,33 into the main body of the bladder, but as the air moves through the branch tubes into the main body of the bladder, it is subjected to heating with the result that by the time the air collects in the main body of the bladder, it is near body temperature such that discharge of simulated blood as a result of heating of air in the bladder is substantially avoided.

The preferred embodiment of by invention illustrated in the drawings and described above is subject to modification without departing from the spirit and scope of the appended claims.

Having described by invention, what I claim as new and desire to secure by Letters Patent is:

I claim:

1. A theatrical accessory comprising in combination a flexible shell body having a fore side and a rear side, the fore side including fang portions, a recess in the rear side of the body for receiving a bladder, a bladder having a main body and a plurality of tubular branches, each branch extending from the body to an apertured end, the bladder mounted in said recess with its tubular branches nested in the rear of respective fangs with their apertured ends adjacent the fang ends whereby a theatrical accessory is provided which may be held in the mouth of the user between the tongue of the user and the upper teeth and mouth surfaces thereabove of the user with the fangs projecting from the mouth of the user, the bladder being compressible by tongue pressure to expel liquid from the bladder adjacent the tips of the fangs.

2. A theatrical accessory in accordance with claim 1 wherein the apertured ends of the tubular branches are concealed by the fang portions of the shell body.

3. A theatrical accessory in accordance with claim 1 wherein resilient attaching means secure the bladder and shell body together to form a unitary resiliently flexible assembly.

4. A theatrical accessory in accordance with claim 3 wherein said resilient attaching means cooperatively join respective tubular branches of the bladder and portions of the fang portion surfaces on which they are nested whereby the resiliency of the accessory is reduced in the vicinity of the tubular branches, fang portions and attaching means while the main body of the bladder and shell body are retained in close spaced relation and subject to limited movement relative to each other.

5. A theatrical accessory in accordance with claim 4 wherein actuation of the bladder by the tongue induces viewable movement of portions of the fangs relative to adjacent viewable portions of the user.

6. A theatrical accessory in accordance with claim 1 wherein the bladder main body and branches are so configured that they may be filled by injecting liquid through the aperture in the end of a lower tubular bladder branch to progressively fill the bladder with liquid displacing air from the bladder through the aperture in the end of the higher bladder branch, whereby expulsion of liquid by body heat expansion of air in the bladder following insertion of the accessory in the mouth of a user may be avoided.

7. A theatrical accessory comprising in combination a flexible shell body having a fore side and a rear side, the fore side including fang portions having recessed rear sides, a recess in the rear side of the body for receiving a bladder, a bladder having a main body and a plurality of tubular branches, each branch extending from the body to an apertured end, the bladder mounted in said recess with its tubular branches nested in the rear of respective fangs with their apertured ends adjacent the fang ends whereby a theatrical accessory is provided which may be held in the mouth of the user between the tongue of the user and the upper teeth and mouth surfaces thereabove of the user with the fangs projecting from the mouth of the user, the bladder being compressible by tongue pressure to expel liquid from the bladder adjacent the tips of the fangs.

8. A theatrical accessory in accordance with claim 7 wherein the apertured ends of the tubular branches are concealed by the fang portions of the shell body.

9. A theatrical accessory in accordance with claim 7 wherein resilient attaching means secure the bladder and shell body together to form a unitary resiliently flexible assembly.

10. A theatrical accessory in accordance with claim 9 wherein said resilient attaching means cooperatively join respective tubular branches of the bladder and portions of the fang portion surfaces on which they are nested whereby the resiliency of the accessory is reduced in the vicinity of the tubular branches, fang portions and attaching means while the main body of the bladder and shell body are retained in close spaced relation and subject to limited movement relative to each other.

11. A theatrical accessory in accordance with claim 10 wherein actuation of the bladder by the tongue induces viewable movement of portions of the fangs relative to adjacent viewable portions of the user.

12. A theatrical accessory in accordance with claim 7 wherein the bladder main body and branches are so configured that they may be filled by injecting liquid through the aperture in the end of a lower tubular bladder branch to progressively fill the bladder with liquid displacing air from the bladder through the aperture in the end of the higher bladder branch, whereby expulsion of liquid by body heat expansion of air in the bladder following insertion of the accessory in the mouth of a user may be avoided.

* * * * *